US010996595B2

(12) United States Patent
Sako et al.

(10) Patent No.: US 10,996,595 B2
(45) Date of Patent: May 4, 2021

(54) HEATER AND FIXING DEVICE

(71) Applicant: CANON KABUSHIKI KAISHA, Tokyo (JP)

(72) Inventors: Masato Sako, Mishima (JP); Tomonori Sato, Hamamatsu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/439,064

(22) Filed: Jun. 12, 2019

(65) Prior Publication Data

US 2019/0384211 A1 Dec. 19, 2019

(30) Foreign Application Priority Data

Jun. 14, 2018 (JP) ..... JP2018-113485

(51) Int. Cl.
*G03G 15/20* (2006.01)

(52) U.S. Cl.
CPC ..... *G03G 15/2017* (2013.01); *G03G 15/2039* (2013.01); *G03G 15/2053* (2013.01); *G03G 2215/2003* (2013.01)

(58) Field of Classification Search
CPC ..... G03G 15/2017; G03G 15/2039; G03G 15/2053; G03G 2215/2003
See application file for complete search history.

(56) References Cited

U.S. PATENT DOCUMENTS

| | | | | |
|---|---|---|---|---|
| 9,235,166 | B2 | 1/2016 | Shimura | |
| 9,915,897 | B2 | 3/2018 | Narahara et al. | |
| 2014/0076878 | A1* | 3/2014 | Shimura | G03G 15/2042 219/216 |
| 2016/0070216 | A1 | 3/2016 | Shimura | |
| 2017/0003632 | A1* | 1/2017 | Jensen | G03G 15/2053 |
| 2017/0060052 | A1* | 3/2017 | Narahara | G03G 15/2053 |

FOREIGN PATENT DOCUMENTS

| | | |
|---|---|---|
| JP | 2014-059508 A | 4/2014 |
| JP | 2016-133711 A | 7/2016 |
| JP | 2017-049399 A | 3/2017 |

* cited by examiner

*Primary Examiner* — Ryan D Walsh
(74) *Attorney, Agent, or Firm* — Venable LLP

(57) ABSTRACT

A heater wherein an elongated substrate, a first electroconductive member, a second electroconductive member, a plurality of heat generating resistors, and a temperature detecting element. The following relationships are satisfied: W≥L and W≥S, where W represents a dimension of the temperature detecting element measured in a longitudinal direction of the substrate, L represents a dimension, measured in the longitudinal direction, of one of the heat generating resistors at least partially overlapping with the temperature detecting element with respect to the longitudinal direction, and S represents a dimension between adjacent heat generating elements of the heat generating elements.

9 Claims, 14 Drawing Sheets

HEATER AND FIXING DEVICE

FIELD OF THE INVENTION AND RELATED ART

The present invention relates to a heater for use with a fixing device mountable in an image forming apparatus heater such as an electrophotographic copying machine or an electrophotographic printer, and relates to a fixing device including the heater.

As the fixing device mounted in the copying machine or the printer of an electrophotographic type, a fixing device of a film heating type has been known. The fixing device of this type includes a rotatable cylindrical film, a plate-like heater for heating the film while contacting an inner peripheral surface of the film, and a pressing roller for forming a nip in cooperation with the heater through the film. A recording material on which an unfixed toner image is carried is heated while being nipped and fed through the nip, whereby the toner image is fixed on the recording material.

In a copying machine or a printer, it has been known that when images are continuously printed on small size recording materials in the same print intervals as those of large size recording materials, non-passing regions of a nip of the fixing device, where the small size recording materials do not pass, excessively increase in temperature. When the non-passing regions of the nip of the fixing device excessively increase in temperature, the film heated by the heater and a holder supporting the heater are damaged.

As a method of suppressing overheating of the non-passing regions of the nip, a device in which a heat generating resistor to be formed on a substrate of a heater is divided into a plurality of heat generating blocks and in which a heat generating distribution of the heater is switched depending on a size of a recording material has been disclosed in Japanese Laid-Open Patent Application (JP-A) 2014-59508. Further, JP-A 2014-59508 also discloses a constitution in which in at least one heat generating block, a plurality of pieces of heat generating resistors are electrically connected in parallel to each other.

In the constitution in which the plurality of pieces of heat generating resistors are electrically connected in parallel to each other, with respect to a longitudinal direction of the heater, a temperature difference generates between a region in which the heat generating resistors exist and a region in which the heat generating resistors do not exist. For this reason, in the case a locating position of a temperature detecting element on the substrate changes due to a variation during manufacturing of the device, there was a possibility that a heat quantity received from the heater by the temperature detecting element changes and thus a detection temperature varies. Further, in recent years, further improvement in image quality has been required, so that it has been desired that accuracy of temperature control of the heater is improved.

SUMMARY OF THE INVENTION

A principal object of the present invention is to provide a heater capable of suppressing a variation in detection temperature even when a locating position of a temperature detecting element on a heating member changes due to a variation during manufacturing of a device.

Another object of the present invention is to provide a fixing device including the heater.

According to an aspect of the present invention, there is provided a heater for use with a fixing device for fixing an image formed on a recording material, comprising: an elongated substrate; a first electroconductive member provided on the substrate along a longitudinal direction of the substrate; a second electroconductive member provided on the substrate along the longitudinal direction; a plurality of heat generating resistors provided between the first electroconductive member and the second electroconductive member and electrically connected between the first electroconductive member and the second electroconductive member in parallel to each other; and a temperature detecting element configured to detect a temperature of the heater, wherein the following relationships are satisfied: $W \geq L$ and $W \geq S$, where W represents a dimension of the temperature detecting element measured in the longitudinal direction, L represents a dimension, measured in the longitudinal direction, of one of the heat generating resistors at least partially overlapping with the temperature detecting element with respect to the longitudinal direction, and S represents a dimension between adjacent heat generating resistors.

Further features of the present invention will become apparent from the following description of exemplary embodiments with reference to the attached drawings.

Figure 4:
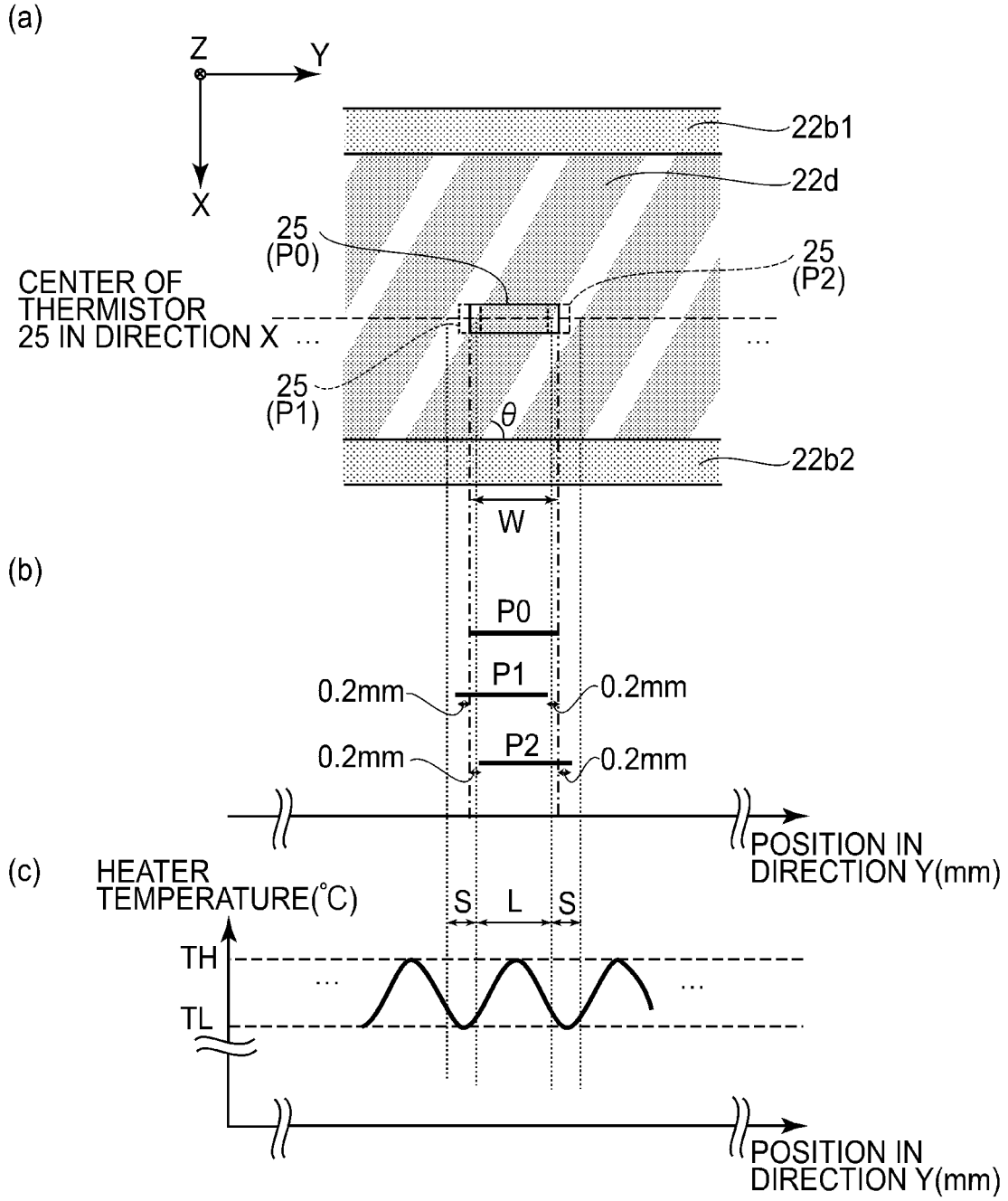

Parts (a), (b) and (c) of FIG. 4 are schematic views showing the case where a locating position of a thermistor is changed relative to the heater.

Figure 5:
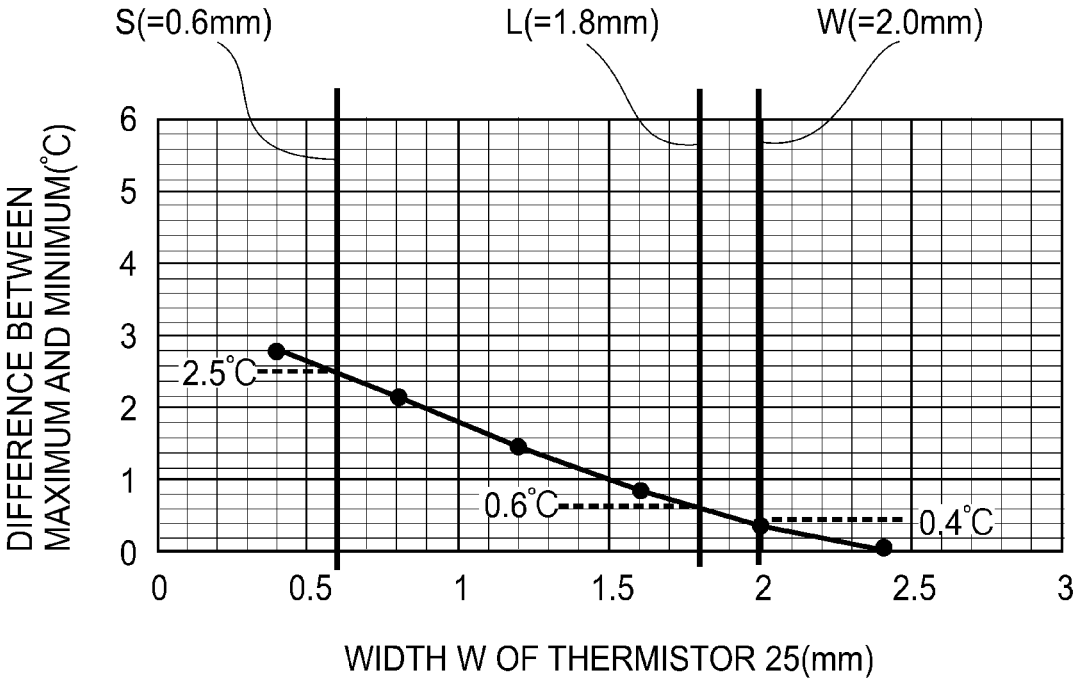

FIG. 5 is a graph showing a difference in detection temperature between a maximum and a minimum relative to a positional deviation between the thermistor and a heat generating resistor.

Figure 6:
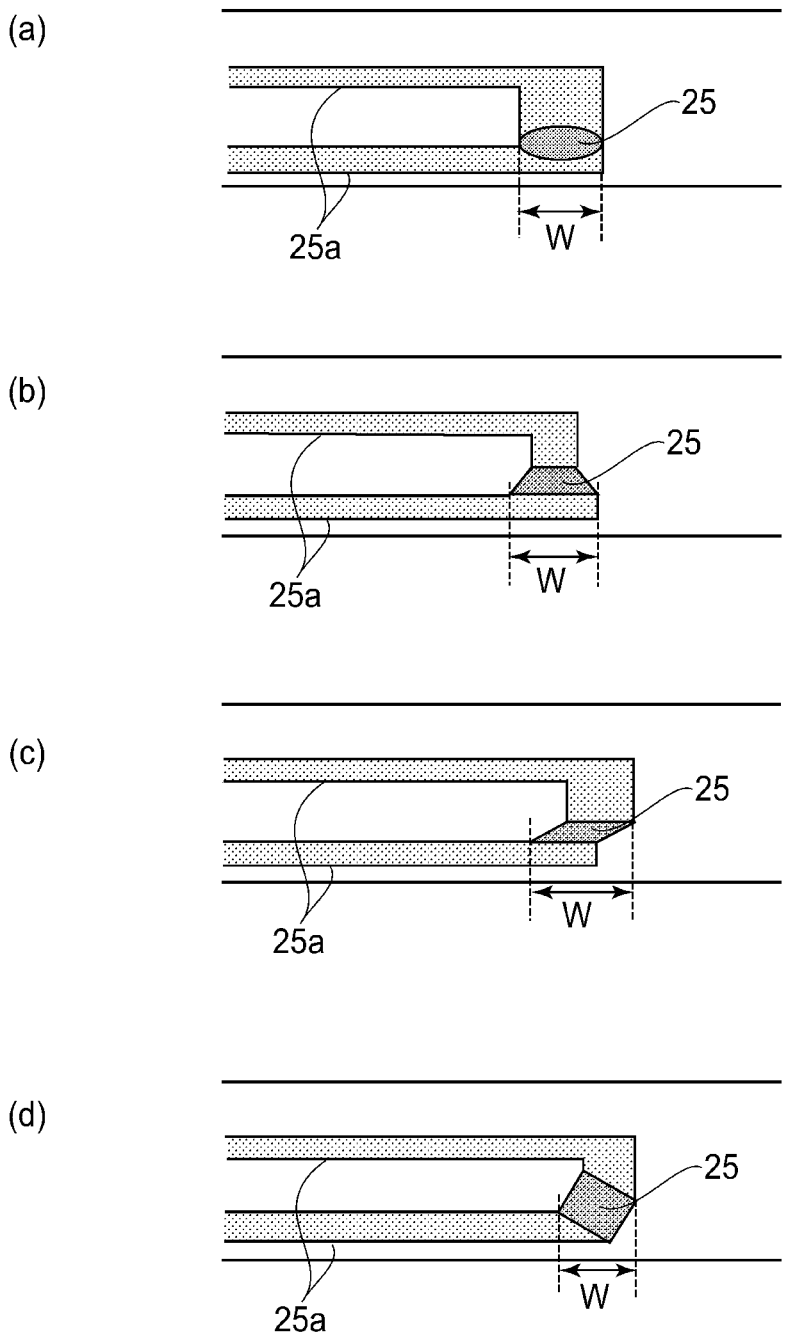

Parts (a) to (d) of FIG. 6 are sectional views showing modified examples of a shape of the thermistor.

Figure 7:
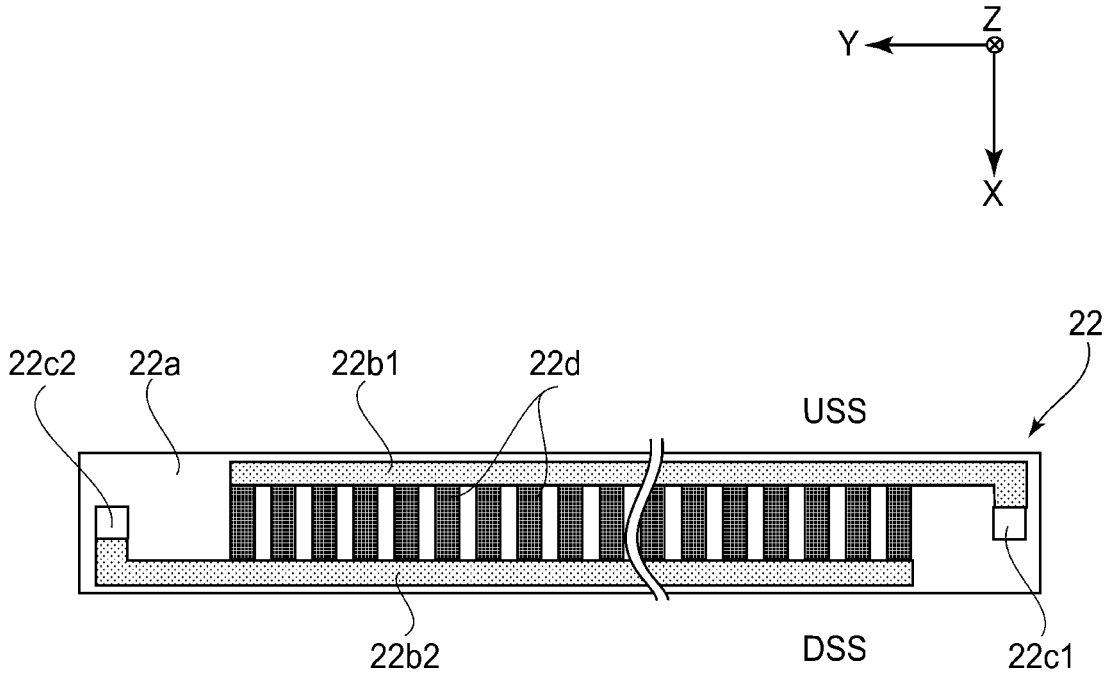

FIG. 7 is a schematic view showing a modified example of an arrangement shape of the heat generating resistor.

Figure 8:
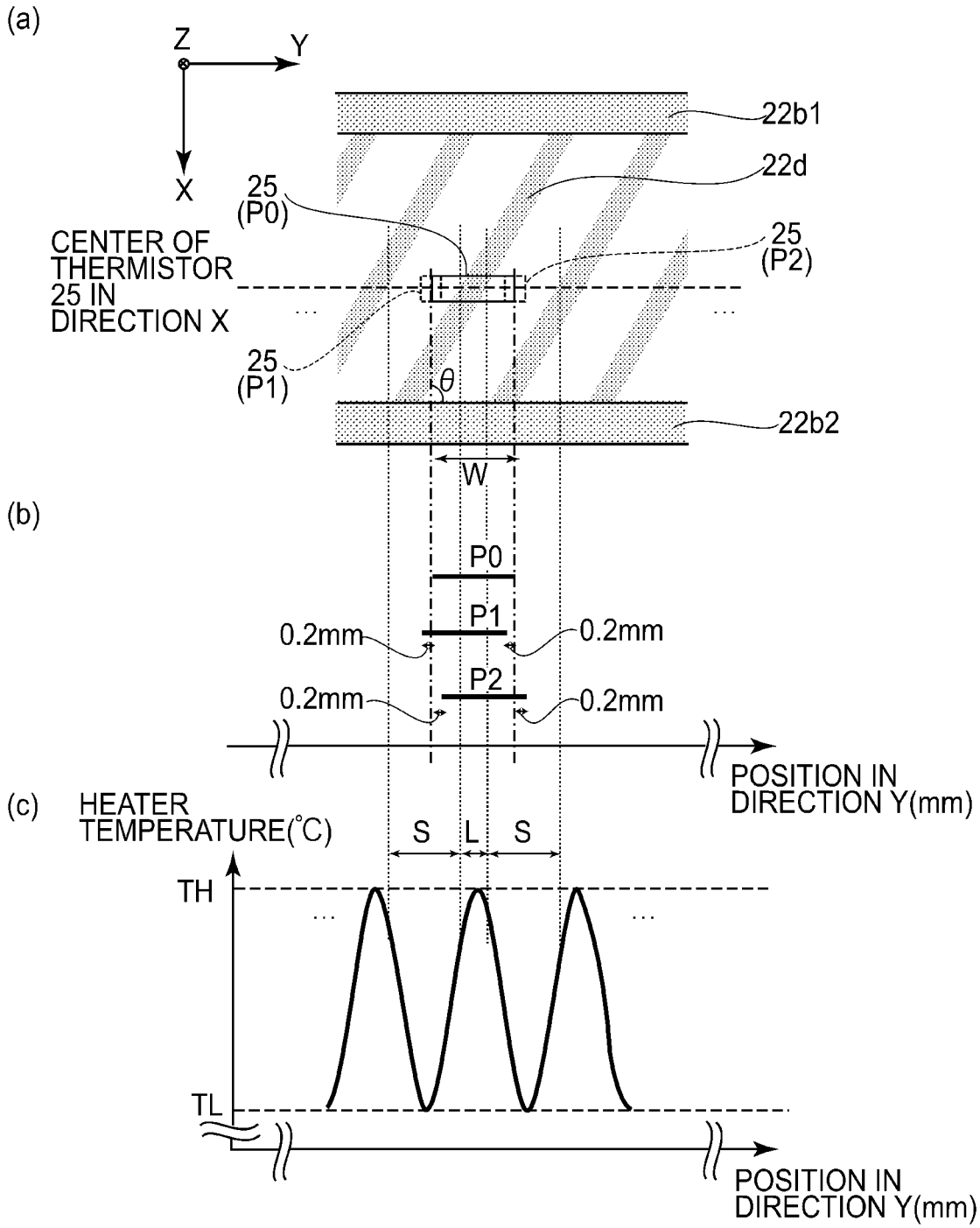

Parts (a), (b) and (c) of FIG. 8 are schematic views showing the case where a locating position of a thermistor is changed relative to a heater of a fixing device according to Embodiment 2.

Figure 9:
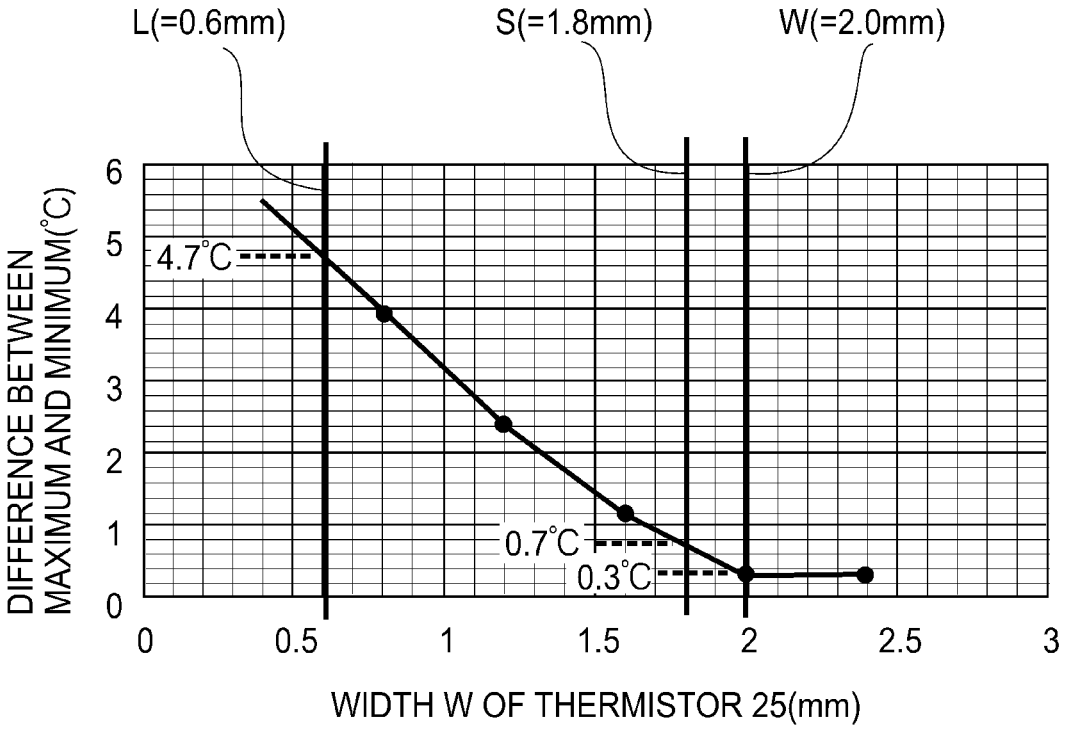

FIG. 9 is a graph showing a difference in detection temperature between a maximum and a minimum relative to a positional deviation between the thermistor and a heat generating resistor in Embodiment 2.

Figure 10:
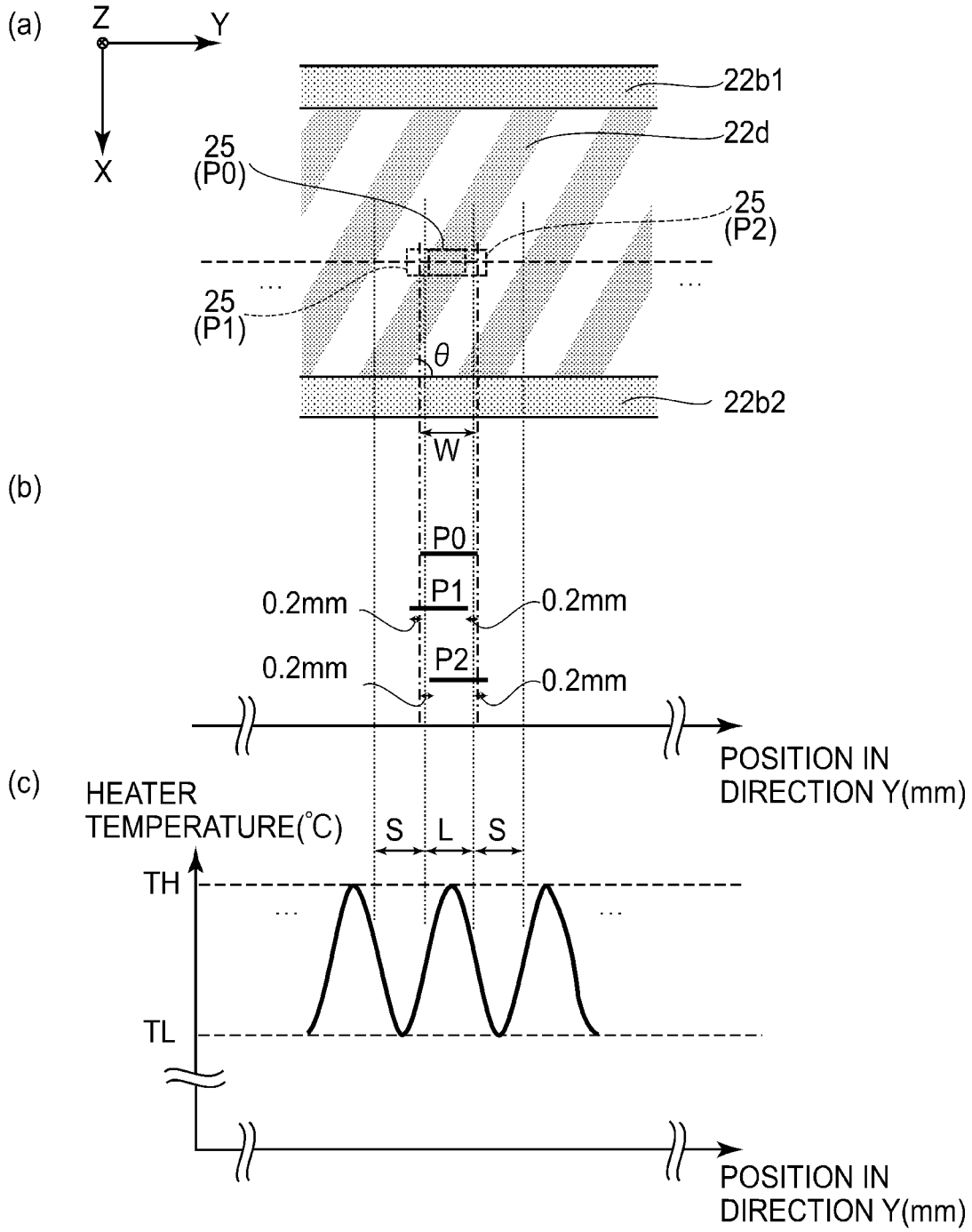

Parts (a), (b) and (c) of FIG. 10 are schematic views showing the case where a locating position of a thermistor is changed relative to a heater of a fixing device according to Embodiment 3.

Figure 11:
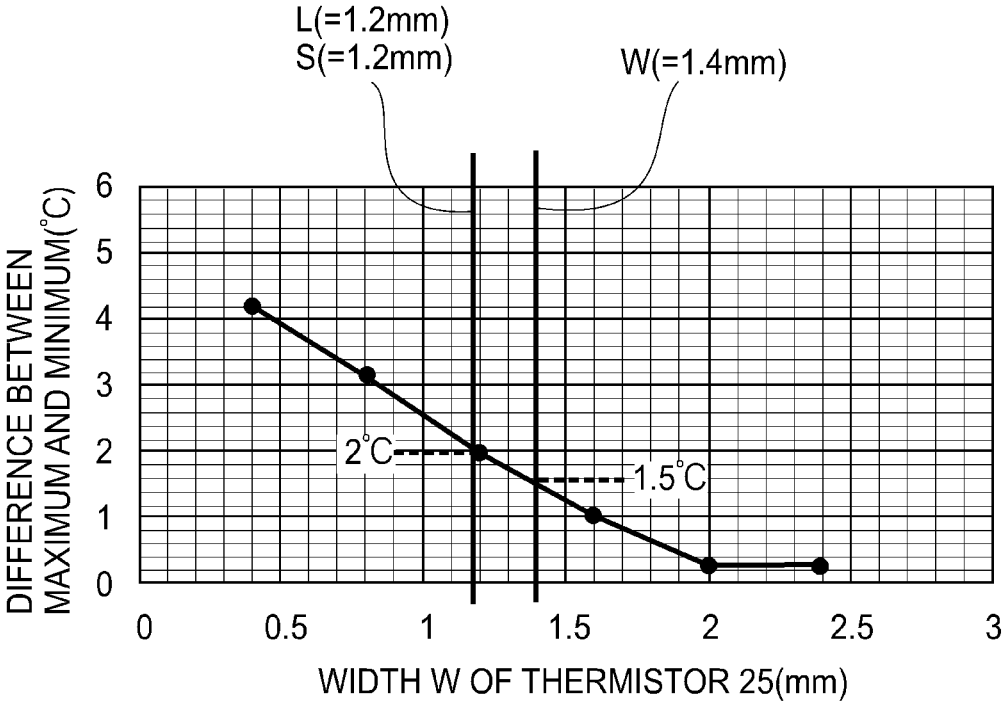

FIG. 11 is a graph showing a difference in detection temperature between a maximum and a minimum relative to a positional deviation between the thermistor and a heat generating resistor in Embodiment 3.

Figure 12:
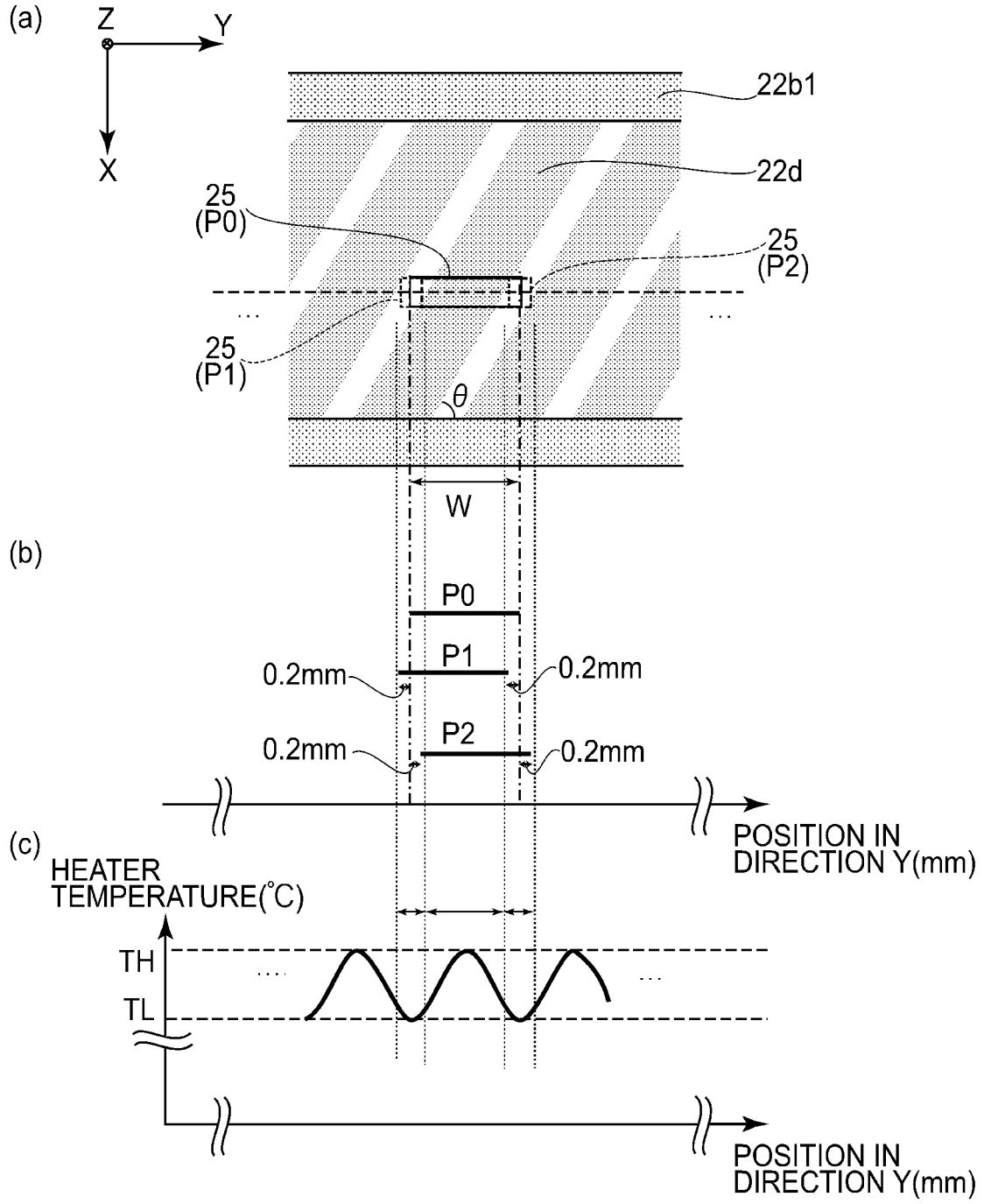

Parts (a), (b) and (c) of FIG. 12 are schematic views showing the case where a locating position of a thermistor is changed relative to a heater of a fixing device according to Embodiment 4.

Figure 13:
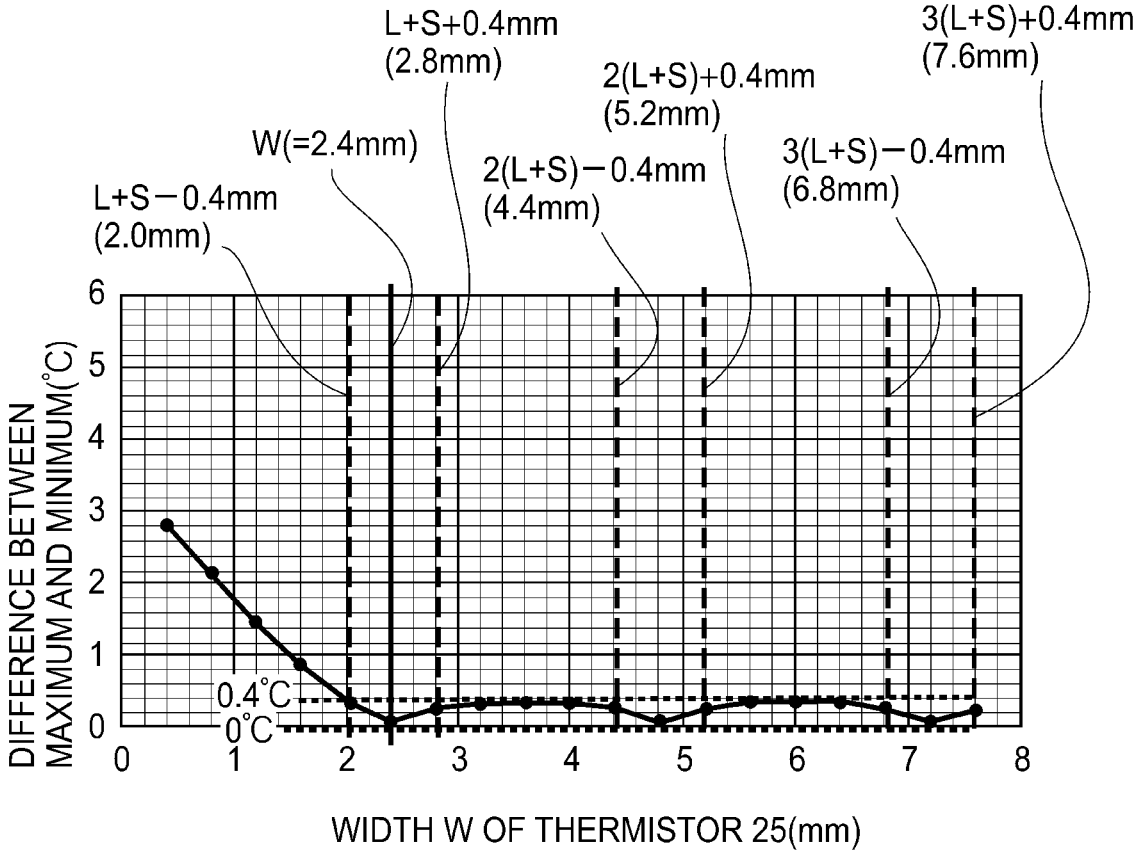

FIG. 13 is a graph showing a difference in detection temperature between a maximum and a minimum relative to a positional deviation between the thermistor and a heat generating resistor in Embodiment 4.

Figure 14:
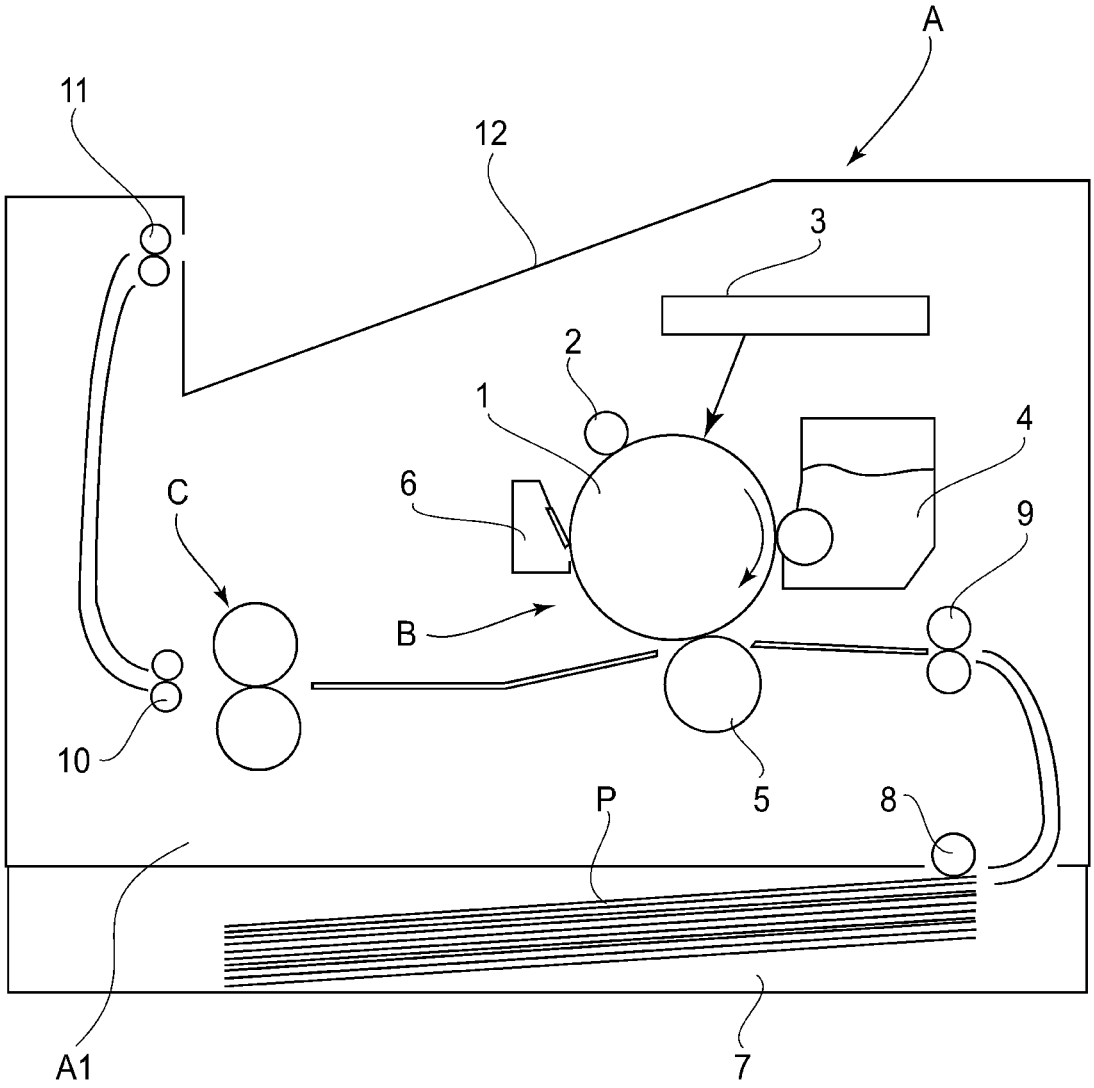

FIG. 14 is a sectional view showing a schematic structure of an image forming apparatus.

DESCRIPTION OF EMBODIMENTS

Embodiments of the present invention will be described with reference to the drawings. Although these embodiments are preferred embodiments of the present invention, the present invention is not limited to the following embodiments, but constitutions thereof can be replaced with other various constitutions within a scope of a concept of the present invention.

Embodiment 1

(1) Image Forming Apparatus A

With reference to FIG. 14, an image forming apparatus A in which a fixing device as a heating device according to the present invention is mounted will be described. FIG. 14 is a sectional view showing a general structure an example of the image forming apparatus (a monochromatic printer in this embodiment) A using an electrophotographic recording technique.

In the image forming apparatus A, an image forming portion 10 for forming images on recording materials includes a photosensitive drum 1 as an image bearing member, a charging member 2, a laser scanner 3, a developing device 4, a transfer member 5 and a cleaner 6 for cleaning an outer peripheral surface of the photosensitive drum 1.

An operation of the image forming portion B is well known, and therefore, will be omitted from detailed description.

Recording materials P accommodated in a cassette 7 in an apparatus main assembly A1 are supplied one by one by rotation of a roller 8, and then the fed recording material P is conveyed, by rotation of a roller pair 9, to a transfer portion formed by the photosensitive drum 1 and the transfer member 5. At the transfer portion, the recording material P on which the toner image is transferred is sent to a fixing device C as a fixing portion, and the toner image is heat-fixed on the recording material P by the fixing device C. The recording material P coming out of the fixing device C is discharged onto a tray 12 by rotation of roller pairs 10 and 11.

(2) Fixing Device C (2-1) Structure

Figure 1:
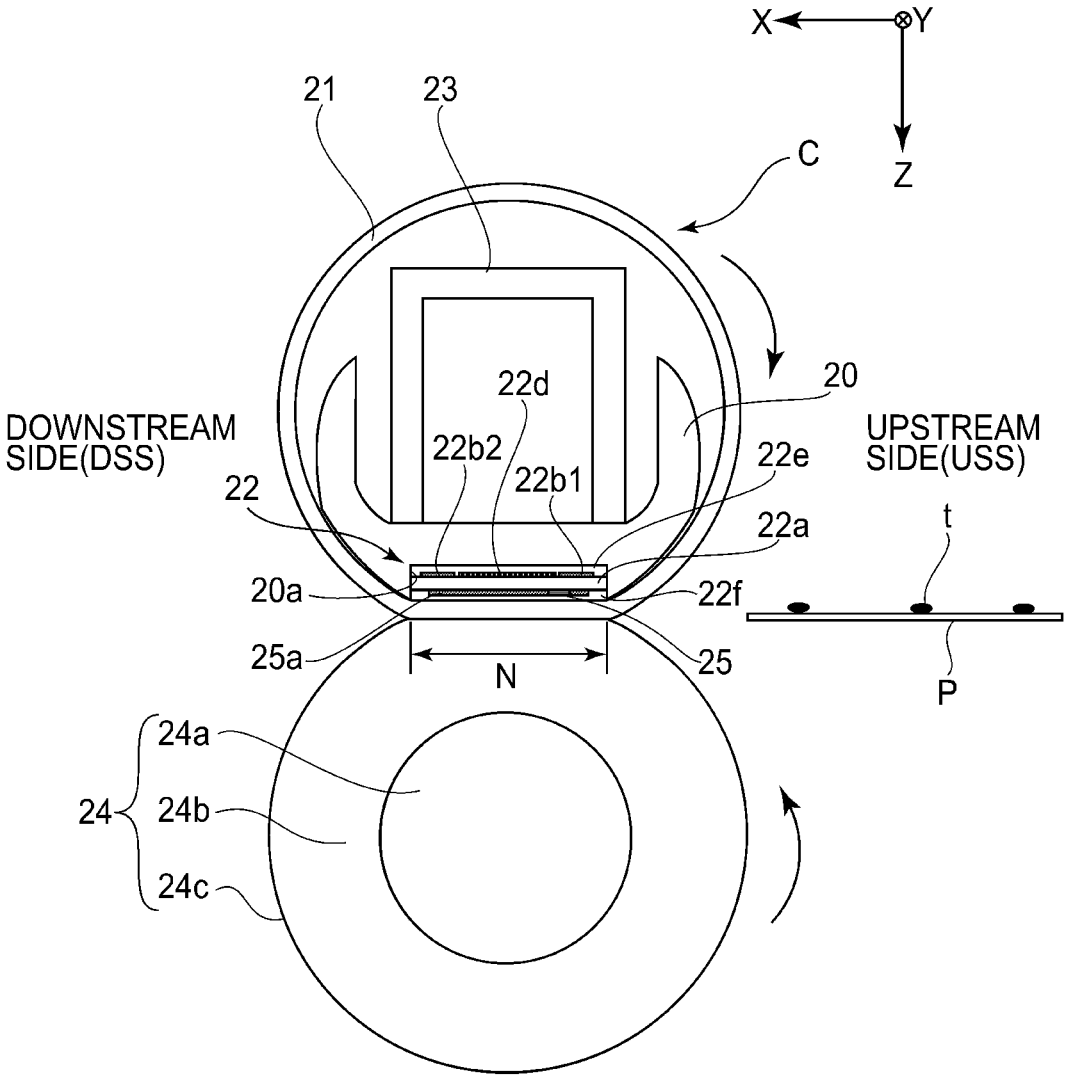
FIG. 1 is a sectional view showing a schematic structure of a fixing device according to Embodiment 1.
Figure 2:
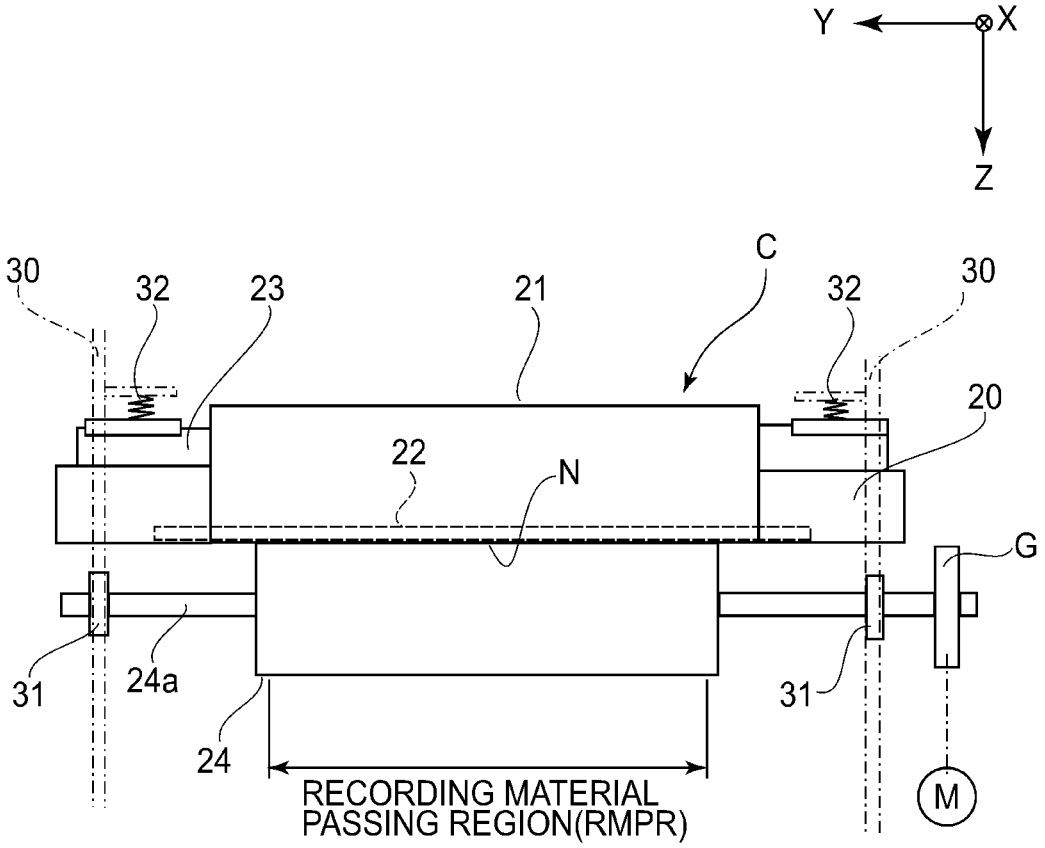
FIG. 2 is a schematic view of the fixing device as seen from an upstream side of a recording material feeding direction.

Then, the fixing device C will be described with reference to FIGS. 1 and 2. The fixing device C in this embodiment is a device of a film heating type. FIG. 1 is a sectional view showing a schematic structure of an entirety of the fixing device C. FIG. 2 is a schematic view of the fixing device C as seen from an upstream side of a recording material feeding direction X.

The fixing device C includes a heat-resistant film 21 as a cylindrical heating member, a ceramic heater 22 as a heating member for heating the film 21 in contact with an inner peripheral surface of the film 21, and a holder 20 as a supporting member for supporting the heater 22. The fixing device C further includes a stay 23 as a reinforcing member and a roller 24 as a pressing member.

The heat-resistant holder 20 inserted in a hollow portion of the film 2 supports the heater 22 by a groove 20*a* provided along a direction Y perpendicular to a recording material feeding direction X on a flat surface of the holder 20 on the roller 24 side. The holder 20 also has a function as a guiding member for guiding rotation of the film 21.

The film 21 has a film thickness of about 40-100 μm in total thickness in order to improve a quick start property by reducing thermal capacity thereof. As this film 21, a single layer film of PI, PTFE, PFA, FEP or the like which have a heat-resistant property, a parting property, strength, a heat-resistant property and the like can be used. Or, a composite layer film prepared by coating a surface layer of PTFE, PFA, FEP or the like on an outer peripheral surface of a film base layer of a material such as polyimide, polyamideimide, PEEK, PES or PPS can be used.

In this embodiment, a film 21 prepared by providing, on an outer peripheral surface of a polyimide film, a coat layer in which an electroconductive agent is added into a fluorine-containing resin material such as PTFE or PFA is used but is not particular about such a film. As the base layer, metal such as stainless steel may also be used. Further, between the base layer and the surface layer, a rubber layer of a silicone rubber may also be provided.

Figure 3:
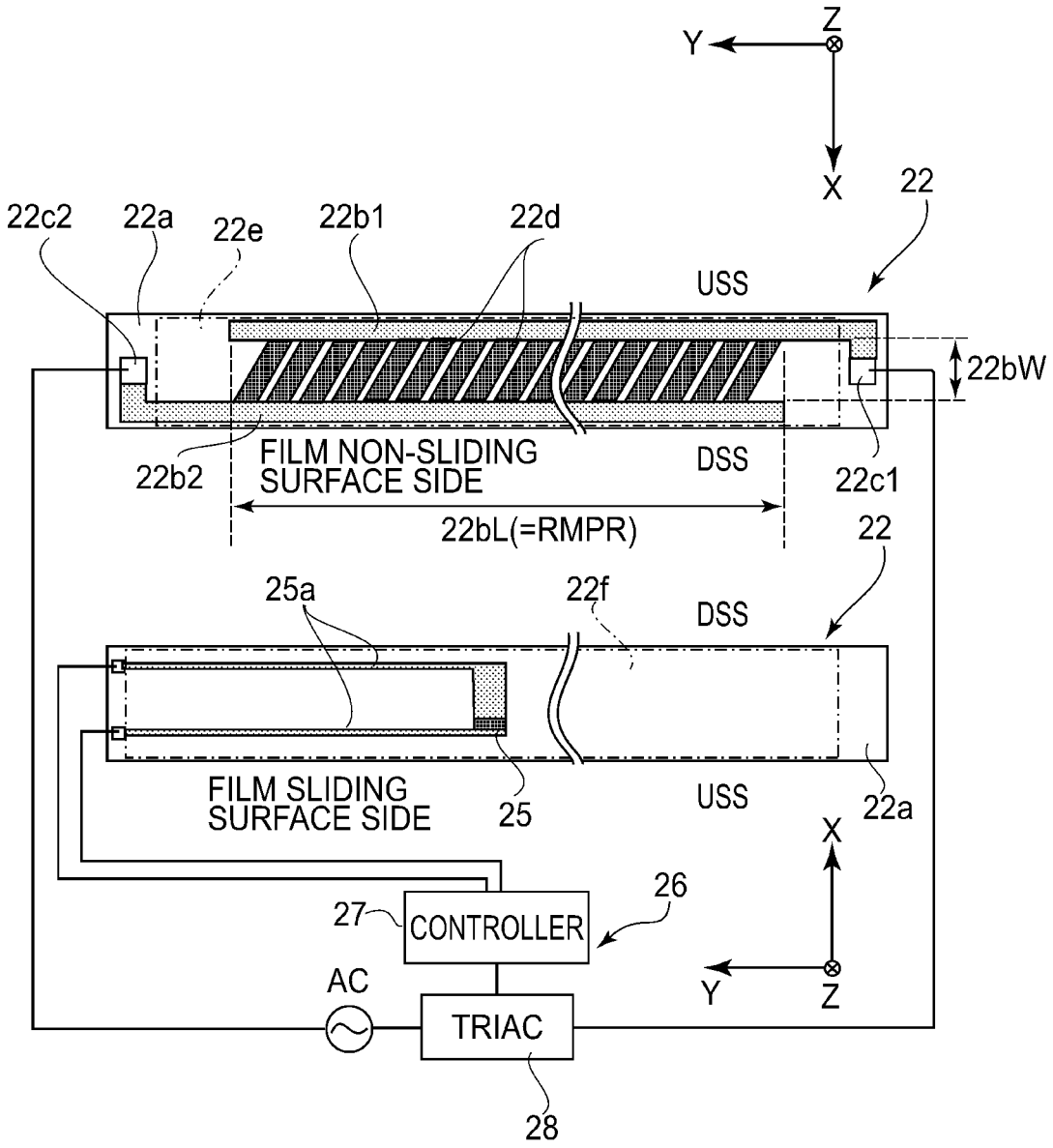
FIG. 3 is a view showing a schematic constitution of a heater and a temperature control circuit of the heater.

FIG. 3 is a schematic structural view of the heater 22 and a temperature control circuit 26 of the heater 22. In FIG. 3, a schematic structure of the heater 22 on a film non-sliding surface side is shown at an upper portion, and a schematic structure of the heater 22 on a film sliding surface side is shown at a lower portion. Incidentally, in FIG. 3, a central region of the heater 22 with respect to the direction Y perpendicular to the recording material feeding direction X is omitted.

The heater 22 includes an elongated substrate 22*a*.

On a flat surface of the substrate 22*a* on the film non-sliding surface side, electroconductive members 22*b*1 and 22*b*2 are provided and extend in the direction Y perpendicular to the recording material feeding direction X, and a plurality of pieces (two pieces in this embodiment) of the electroconductive members are disposed with respect to the recording material feeding direction X. The electroconductive member (first electroconductive member) 22*b*1 is provided along the direction Y perpendicular to the recording material feeding direction X on an upstream side of the substrate 22*a* with respect to the recording material feeding direction X, and the electroconductive member (second electroconductive member) 22*b*2 is provided along the direction Y perpendicular to the recording material feeding direction X on a downstream side of the substrate 22*a* with respect to the recording material feeding direction X.

A material of each of the electroconductive members 22*b*1 and 22*b*2 is Ag or Ag/Pt, and each of the electroconductive members 22*b*1 and 22*b*2 is about 1 mm in dimension measured in the direction X and is several tens of μm in thickness with respect to a direction Z. The electroconductive members 22*b*1 and 22*b*2 are applied onto the substrate 22*a* by screen printing. With respect to the direction Y, to one end portion of the electroconductive member 22*b*1, an electrode 22*c*1 is electrically connected, and to the other end portion 22*b*2, an electrode 22*c*2 is electrically connected.

The heater 22 further includes a plurality of pieces of heat generating resistors for generating heat by energization. The plurality of pieces of heat generating resistors 22*d* are made of Ag/Pd (silver/palladium) having a PTC (positive temperature coefficient) and is applied in a thickness of about several tens of μm onto the flat surface of the substrate 22*a* by screen printing.

In this embodiment, between the two pieces of the electroconductive members 22*b*1 and 22*b*2 (22*b*W in dimension therebetween), the plurality of pieces (90 pieces in this embodiment) of the heat generating resistors 22*d* are connected in parallel to each other. A dimension 22*b*L is a recording material passing region and is also a region where the heat generating resistors 22*d* are provided. The heat generating resistors 22*d* provided in plurality of pieces are disposed obliquely to the direction Y and the direction X. These plurality of pieces of the heat generating resistors 22*d* overlap with adjacent pieces of the heat generating resistors. As a result, it is possible to suppress non-uniformity of a temperature distribution.

In this embodiment, 22*b*L=220 mm and 22*b*W=7 mm are set.

A protective layer 22*e* covers the electroconductive members 22*b*1 and 22*b*2 and the heat generating resistors 22*d*. As the protective layer 22*e*, a glass layer or a fluorine-containing resin layer is used.

A thermistor 25 as a temperature detecting element is provided on the flat surface of the substrate 22*a* on the film sliding surface side, and is prepared by printing a material having a NTC (negative temperature coefficient) on the flat surface of the substrate 22*a*.

To the thermistor 25, electroconductive patterns 25*a* are electrically connected. The electroconductive patterns 25*a* extend from the thermistor 25 toward an end portion of the substrate 22*a* in the direction Y.

A protective layer 22*f* covers an entire region of the film sliding surface of the substrate 22*a*. As the protective layer 22*f*, a glass layer or a fluorine-containing resin layer is used.

As shown in FIG. 1, at the hollow portion of the film 21, the stay 23 is provided on a surface of the holder 20 on a side opposite from the surface of the holder 20 on the roller 24 side. The stay 23 is made of metal (iron) and has a function of reinforcing the holder 20.

The roller 24 includes a core metal 24*a* made of iron, aluminum or the like, and a roller portion 24*b* of a silicone rubber provided on an outer peripheral surface of the core metal 24*a* and is 3 mm in thickness and 20 mm in outer diameter. On an outer peripheral surface of the roller portion 24*b*, a parting layer 24*c* in which a fluorine-containing resin material is dispersed from the viewpoints of a conveying property of the film 21 and prevention of contamination with toner is provided.

As shown in FIG. 2, by left and right frames 30 of the fixing device C, opposite end portions of the core metal 24*a* of the roller 24 are rotatably supported via bearings 31. Further, by the frames 30, opposite end portions of the holder 20 and opposite end portions of the stay 23 are supported.

The opposite end portions of the stay 23 are pressed by springs 32 in a direction (recording material thickness direction Z) perpendicular to a generatrix direction of the film 21. By this pressure, the holder 20 presses the heater 22 against an inner surface of the film 21, so that the outer peripheral surface (surface) of the film 21 is press-contacted to an outer peripheral surface (surface) of the roller 24. As a result, the roller portion 24*b* of the roller 24 is depressed and elastically deformed, so that a nip N is formed by the roller surface and the film surface.

(2-2) Heat-Fixing Process Operation

When a gear G (FIG. 2) provided at one end portion of the core metal 24*a* of the roller 24 is rotationally driven by a motor member, the roller 24 is rotated in an arrow direction of in FIG. 1. The film 21 is rotated in an arrow direction of FIG. 1 by rotation of the roller 24 while the inner surface thereof slides on the protecting layer 22*e* of the heater 22.

When electric power is supplied from a power (voltage) source AC (FIG. 3) to the heat generating resistors 22*d* through the electrodes 22*c*1 and 22*c*2 and the electroconductive members 22*b*1 and 22*b*2, the heat generating resistors 22*d* generate heat, so that the heater 22 is abruptly increased in temperature. A controller 27 acquires a detection temperature (accurately a voltage depending on a temperature of the heater 22) from the thermistor 25 through the electroconductive patterns 25*a*, and controls an amount of electric power supplied to the heater 22 by controlling a triac 28 so that the detection temperature is maintained at a predetermined fixing temperature (target temperature).

The recording material P carrying unfixed toner images (unfixed images) t thereon is heated while being nipped and fed through the nip N, whereby the toner images are fixed on the recording material P.

(3) Detection Temperature when a Locating Position of Thermistor 25 Changes

Parts (a), (b) and (c) of FIG. 4 are schematic views showing the case where a locating position of the thermistor 25 relative to the heater 22 changed. In part (a) of FIG. 4, a positional relationship of the heater 22 relative to the heat generating resistor 22*d* provided on the heater 22 on the film non-sliding surface side and relative to the thermistor 25 provided on the heater 22 on the film sliding surface side. Further, in part (a) of FIG. 4, a thermistor 25 (P0) located at a position P0 and indicated by a solid line, a thermistor 25 (P1) located at a position P1 and indicated by a dotted line, and a thermistor 25 (P2) located at a position P2 and indicated by a broken line are shown. A dimension and an inclination are common to all the plurality of pieces of the heat generating resistors 22*d*.

With respect to the direction Y, a dimension of the thermistor 25 is W, and a dimension in which the thermistors 25 (P1, P2 and P3) overlap with each other is L. A dimension of a region, between adjacent heat generating resistors 22*d*, where the thermistor 25 is locatable and where the heat generating resistors 22*d* do not exist is S. In this embodiment, L=1.8 mm and S=0.6 mm, so that a relationship of L≥S is satisfied. Further, W=2.0 mm is set. Accordingly, relationships of W≥L and W≥S are satisfied.

Here, in the device C of this embodiment, a tolerance of a relative position between the thermistor 25 and the heater 22 with respect to the direction Y is ±0.2 mm.

In part (b) of FIG. 4, relationships of positions and dimensions, with respect to the direction Y, of the thermistors 25 disposed at the positions P0, P1 and P2 are shown. The position P0 shows the case where the thermistor 25 is in a design center position. The position P1 shows the case where the locating position of the thermistor 25 is on a leftmost side in terms of the tolerance, and the position P2 shows the case where the locating position of the thermistor 25 is on a rightmost side in terms of the tolerance.

In part (c) of FIG. 4, a temperature distribution of the heater 22 at a center position of the thermistor 25 with respect to the direction X when the recording materials P are continuously supplied to the nip N while supplying certain electric power to the heater 22. In this embodiment, A4-size sheets of plain paper (80 g/m$^2$) are continuously supplied to the nip N at a speed of 40 sheets per minute at supplied electric power of 600 W.

As shown in part (c) of FIG. 4, between a region where the heat generating resistors 22*d* exist and a region where the heat generating resistors 22*d* do not exist, a temperature ripple occurs in the temperature distribution of the heater 22. The temperature ripple is represented by TH which is a maximum (highest) temperature and by TL which is a minimum (lowest) temperature, and TH is about 250° C. and TL is about 220° C.

When the locating position of the thermistor 25 shifts in the direction Y due to a variation during manufacturing of the device C, the temperature distribution within a range of the dimension W of the thermistor 25 changes, so that a heat quantity received from the heater 22 by the thermistor 25 changes. As a result, a resistance value of the thermistor 25 changes, so that a variation in detection temperature occurs. In this embodiment, a difference between a maximum (value) and a minimum (value) of the detection temperature with respect to the positional deviation due to the tolerance is defined as the variation in detection temperature. In the image forming apparatus A in which the device C is mounted, in order to suppress a lowering in image quality such as uneven glossiness, there is a need that the variation in detection temperature of the thermistor 25 is made 2° C. or less.

A result of verification as to the device C of this embodiment by the present inventors is shown in FIG. 5. FIG. 5 is a graph showing a difference between a maximum and a minimum of the detection temperature of the thermistor 25 with respect to the positional deviation between the thermistor 25 and the heat generating resistors 22*d*. In FIG. 5, as regards the locating position of the thermistor 25, the difference between the maximum and the minimum of the detection temperature when the thermistor 25 is disposed while changing the dimension W of the thermistor 25 from 0.4 mm to 2.4 mm by a 0.4 mm without changing the locating position from the position shown in part (a) of FIG. 4.

As shown in FIG. 5, with a larger dimension W of the thermistor 25, a change in heat quantity received from the heater 22 by the thermistor 25 in the case where the positional deviation is caused becomes smaller, so that a change rate of a resistance value of the thermistor 25 becomes smaller. In this embodiment, the dimension L of the thermistor 25 in the region where the heat generating resistors 22*d* exist is larger than the dimension S of the region where the heat generating resistors 22*d* do not exist. For that reason, the influence of heat conduction from the region, where the heat generating resistors 22*d* exist, to the thermistor 25 is relatively larger than the influence of heat conduction from the region, where the heat generating resistors do not exist, to the thermistor 25.

Accordingly, in the case where W≥S (=0.6 mm) is satisfied, the difference between the maximum and the minimum of the detection temperature reaches 2.5° C. at the maximum, so that a lowering in image quality cannot be sufficiently suppressed. In the case where in addition to W≥S, W≥L (=1.8 mm) is also satisfied, it is understood that the difference between the maximum and the minimum of the detection temperature falls within 0.6° C. or less. In this embodiment, W=2.0 mm and therefore the difference between the maximum and the minimum is 0.4° C.

In the device C of this embodiment, when L, S and W satisfies relationships of W≥L and W≥S, a variation of the detection temperature of the thermistor 25 in the case where a contact position of the thermistor 25 and the heater 22 varies can be suppressed to 2° C. or less. For that reason, temperature control of the heater 22 can be carried out with accuracy, so that the image quality can be further improved.

Here, L, S and W are not limited to the above-described numerical values, but when the relationships of W≥L and W≥S are satisfied, a similar effect can be obtained. For example, in the case of L=3.0 mm and S=1.0 mm, when W is set at W=3.0 mm or more, a similar effect can be obtained.

A shape of the thermistor 25 is not limited to a rectangular shape. Parts (a) to (d) of FIG. 6 are schematic views showing modified examples of the shape of the thermistor 25. The shape of the thermistor 25 may also be an elliptical shape (part (a) of FIG. 6), a trapezoidal shape (part (b) of FIG. 6), a parallelogram (part (c) of FIG. 6) or an inclined rectangular shape (part (d) of FIG. 6). In these shapes of the thermistor 25, the maximum dimension measured in the direction Y is defined as W.

In this embodiment, the thermistor 25 was disposed on the film sliding surface side of the heater 22, and the electroconductive members 22*b*1 and 22*b*2 and the heat generating resistors 22*d* were disposed on the film non-sliding surface side of the heater 22, but the thermistor 25 may also be disposed on the film non-sliding surface side. In this case, the thermistor 25 is formed, as an upper layer, on the protective layer 22*e* by printing. Similarly, the electroconductive members 22*b*1 and 22*b*2 and the heat generating resistors 22*d* may also be disposed on the film sliding surface side. In this case, the electroconductive members 22*b*1 and 22*b*2 and the heat generating resistors are formed, as an upper layer, on the protective layer 22*f* by printing.

The heat generating resistors 22*d* may also be not formed in an inclined manner with respect to the direction Y and the direction X. FIG. 17 is a schematic view showing a modified example of a disposed shape of the heat generating resistors 22*d*. The plurality of pieces of the heat generating resistors 22*d* may also be formed in a shape extending in parallel along the recording material feeding direction X.

Embodiment 2

Another embodiment of the fixing device C will be described.

In the device C of this embodiment, the dimension L of the heat generating resistor 22*d* of the heater 22 and the distance S of adjacent heat generating resistors 22*d* are different from those of Embodiment 1. In this embodiment, L=0.6 mm and S=1.8 mm are set, so that a relationship of L<S is satisfied. The dimension W of the thermistor is 2.0 mm. This satisfies relationships of W≥L and W≥S.

Parts (a), (b) and (c) of FIG. 8 are schematic views showing the case where a locating position of the thermistor 25 relative to the heater 22 changed. In part (a) of FIG. 8, a positional relationship of the heater 22 relative to the heat generating resistor 22*d* provided on the heater 22 on the film non-sliding surface side and relative to the thermistor 25 provided on the heater 22 on the film sliding surface side. A position, a dimension and an inclination are common to all the plurality of pieces of the heat generating resistors 22*d*.

Here, also in the device C of this embodiment, a contact position between the thermistor 25 and the heater 22 has a tolerance of ±0.2 mm with respect to the direction Y.

In part (b) of FIG. 8, relationships of positions and dimensions, with respect to the direction Y, of the thermistors 25 disposed at the positions P0, P1 and P2 are shown. The position P0 shows the case where the thermistor 25 is in a design center position. The position P1 shows the case where the locating position of the thermistor 25 is on a leftmost side in terms of the tolerance, and the position P2 shows the case where the locating position of the thermistor 25 is on a rightmost side in terms of the tolerance.

In part (c) of FIG. 8, a temperature distribution of the heater 22 at a position of the thermistor 25 when the recording materials P are continuously supplied to the nip N while supplying certain electric power to the heater 22. Also in this embodiment, similarly as in Embodiment 1, A4-size sheets of plain paper (80 g/m$^2$) are continuously supplied to the nip N at a speed of 40 sheets per minute at supplied electric power of 600 W.

As shown in part (c) of FIG. 8, between a region where the heat generating resistors 22*d* exist and a region where the heat generating resistors 22*d* do not exist, a temperature ripple occurs in the temperature distribution of the heater 22 with respect to the direction Y. The maximum temperature TH of the temperature ripple is about 250° C. and the minimum temperature TL of the temperature ripple is about 140° C.

A result of verification as to the device C of this embodiment by the present inventors is shown in FIG. 9. FIG. 9 is a graph showing a difference between a maximum and a minimum of the detection temperature of the thermistor 25 with respect to the positional deviation between the thermistor 25 and the heat generating resistors 22*d*. In FIG. 9, as regards the locating position of the thermistor 25, the difference between the maximum and the minimum of the detection temperature when the thermistor 25 is disposed while changing the dimension W of the thermistor 25 from 0.4 mm to 2.4 mm by a 0.4 mm without changing the locating position from the position of part (a) of FIG. 8.

As shown in FIG. 9, with a larger dimension W of the thermistor 25, a change in heat quantity received from the heater 22 by the thermistor 25 in the case where the positional deviation is caused becomes smaller, so that a change rate of a resistance value of the thermistor 25 becomes smaller. In this embodiment, the dimension S of the region where the heat generating resistors 22*d* do not exist is larger than the dimension L of the heat generating resistor 22*d*. For that reason, the influence of heat conduction from the region, where the heat generating resistors 22*d* do not exist, to the thermistor 25 is relatively larger than the influence of heat conduction from the region, where the heat generating resistors exist, to the thermistor 25.

Accordingly, in the case where W≥L (=0.6 mm) is satisfied, the difference between the maximum and the minimum of the detection temperature reaches 4.7° C., so that a lowering in image quality cannot be sufficiently suppressed. In the case where W≥L and W≥S (=1.8 mm) also satisfied, it is understood that the difference between the maximum and the minimum of the detection temperature falls within 0.7° C. or less. In this embodiment, W=2.0 mm and therefore the difference between the maximum and the minimum is 0.3° C.

In the device C of this embodiment, when L, S and W satisfies relationships of W≥L and W≥S, a variation of the detection temperature of the thermistor 25 in the case where a contact position of the thermistor 25 and the heater 22 varies can be suppressed to 2° C. or less. For that reason, temperature control of the heater 22 can be carried out with accuracy, so that the image quality can be further improved.

Embodiment 3

Another embodiment of the fixing device C will be described.

In the device C of this embodiment, the dimension L of the heat generating resistor 22*d* of the heater 22 and the distance S of adjacent heat generating resistors 22*d* are different from those of Embodiment 1. In this embodiment, L=1.2 mm and S=1.2 mm are set, so that a relationship of L=S is satisfied. The dimension W of the thermistor is 1.4 mm. This satisfies relationships of W≥L and W≥S.

Parts (a), (b) and (c) of FIG. 10 are schematic views showing the case where a locating position of the thermistor 25 relative to the heater 22 changed. In part (a) of FIG. 10, a positional relationship of the heater 22 relative to the heat generating resistor 22*d* provided on the heater 22 on the film non-sliding surface side and relative to the thermistor 25 provided on the heater 22 on the film sliding surface side. A position, a dimension and an inclination are common to all the plurality of pieces of the heat generating resistors 22*d*.

Here, also in the device C of this embodiment, a contact position between the thermistor 25 and the heater 22 has a tolerance of ±0.2 mm with respect to the direction Y.

In part (b) of FIG. 10, relationships of positions and dimensions of the thermistors 25 disposed at the positions P0, P1 and P2 are shown. The position P0 shows the case where the thermistor 25 is in a design center position. The position P1 shows the case where the locating position of the thermistor 25 is on a leftmost side in terms of the tolerance, and the position P2 shows the case where the locating position of the thermistor 25 is on a rightmost side in terms of the tolerance.

In part (c) of FIG. 10, a temperature distribution of the thermistor 25 when the recording materials P are continuously supplied to the nip N while supplying certain electric power to the heater 22. Also in this embodiment, similarly as in Embodiment 1, A4-size sheets of plain paper (80 g/m$^2$) are continuously supplied to the nip N at a speed of 40 sheets per minute at supplied electric power of 600 W.

As shown in part (c) of FIG. 10, between a region where the heat generating resistors 22*d* exist and a region where the heat generating resistors 22*d* do not exist, a temperature ripple occurs in the temperature distribution of the heater 22 with respect to the direction Y perpendicular to the recording material feeding direction x. The maximum temperature TH of the temperature ripple is about 250° C. and the minimum temperature TL of the temperature ripple is about 170° C.

A result of verification as to the device C of this embodiment by the present inventors is shown in FIG. 11. FIG. 11 is a graph showing a difference between a maximum and a minimum of the detection temperature of the thermistor 25 with respect to the positional deviation between the thermistor 25 and the heat generating resistors 22*d*. In FIG. 11, as regards the locating position of the thermistor 25, the difference between the maximum and the minimum of the detection temperature when the thermistor 25 is disposed while changing the dimension W of the thermistor 25 from 0.4 mm to 2.4 mm by a 0.4 mm without changing the locating position from the position of part (a) of FIG. 10.

As shown in FIG. 11, with a larger dimension W of the thermistor 25, a change in heat quantity received from the heater 22 by the thermistor 25 in the case where the positional deviation is caused becomes smaller, so that a change rate of a resistance value of the thermistor 25 becomes smaller. In this embodiment, the dimension S of the region where the heat generating resistors 22*d* do not exist is equal to the dimension L of the heat generating resistor 22*d*. For that reason, the influence of heat conduction from the region, where the heat generating resistors 22*d* do not exist, to the thermistor 25 is substantially equal to the influence of heat conduction from the region, where the heat generating resistors exist, to the thermistor 25.

Accordingly, when W is not less than L or S (=1.2 mm), it is understood that the difference between the maximum and the minimum of the detection temperature falls within 2° C. or less. In this embodiment, W=1.4 mm and therefore the difference between the maximum and the minimum is 1.5° C.

In the device C of this embodiment, when L, S and W satisfies relationships of W≥L and W≥S, a variation of the detection temperature of the thermistor 25 in the case where a contact position of the thermistor 25 and the heater 22 varies can be suppressed to 2° C. or less. For that reason, temperature control of the heater 22 can be carried out with accuracy, so that the image quality can be further improved.

Embodiment 4

Another embodiment of the fixing device C will be described.

In the device C of this embodiment, the dimension W is different from that of Embodiment 1. In this embodiment, the dimension W is 2.4 mm. This satisfies relationship of (integral multiple of L+S)−0.4 mm≤W≤(integral multiple of L+S)+0.4 mm (almost integral multiple of L+S).

Parts (a), (b) and (c) of FIG. 12 are schematic views showing the case where a locating position of the thermistor 25 relative to the heater 22 changed. In part (a) of FIG. 12, a positional relationship of the heater 22 relative to the heat generating resistor 22*d* provided on the heater 22 on the film non-sliding surface side and relative to the thermistor 25 provided on the heater 22 on the film sliding surface side. A position, dimension and an inclination are common to all the plurality of pieces of the heat generating resistors 22*d*.

Here, also in the device C of this embodiment, a contact position between the thermistor 25 and the heater 22 has a tolerance of ±0.2 mm with respect to the direction Y.

In part (b) of FIG. 12, relationships of positions and dimensions of the thermistors 25 disposed at the positions P0, P1 and P2 are shown. The position P0 shows the case where the thermistor 25 is in a design center position. The position P1 shows the case where the locating position of the thermistor 25 is on a leftmost side in terms of the tolerance, and the position P2 shows the case where the locating position of the thermistor 25 is on a rightmost side in terms of the tolerance.

In part (c) of FIG. 12, a temperature distribution of the thermistor 25 when the recording materials P are continuously supplied to the nip N while supplying certain electric power to the heater 22. Also in this embodiment, similarly as in Embodiment 1, A4-size sheets of plain paper (80 g/m$^2$) are continuously supplied to the nip N at a speed of 40 sheets per minute at supplied electric power of 600 W.

As shown in part (c) of FIG. 12, between a region where the heat generating resistors 22*d* exist and a region where the heat generating resistors 22*d* do not exist, a temperature ripple occurs in the temperature distribution of the heater 22. The maximum temperature TH of the temperature ripple is about 250° C. and the minimum temperature TL of the temperature ripple is about 220° C.

A result of verification as to the device C of this embodiment by the present inventors is shown in FIG. 13. FIG. 13 is a graph showing a difference between a maximum and a minimum of the detection temperature of the thermistor 25 with respect to the positional deviation between the thermistor 25 and the heat generating resistors 22*d* due to a tolerance of a contact position between the thermistor 25 and the heat generating resistors 22*d*. In FIG. 13, as regards the locating position of the thermistor 25, the difference between the maximum and the minimum of the detection temperature when the thermistor 25 is disposed while changing the dimension W of the thermistor 25 from 0.4 mm to 7.6 mm by a 0.4 mm without changing the locating position from the position of part (a) of FIG. 12.

As in this embodiment, when the dimension W of the thermistor 25 is not less than (integral multiple of L+S)−0.4 mm and is not more than (integral multiple of L+S)+0.4 mm (almost integral multiple of L+S), an area of the heat generating resistors 22*d* and an area, where the heat generating resistors 22*d* do not exist, which are included in the thermistor 25 in the case where the positional deviation of the thermistor 25 is caused can be maintained at substantially certain values. For that reason, heat quantity received from the heater 22 by the thermistor 25 can be maintained at a substantially certain value. Therefore, a change in resistance value of the thermistor can be further suppressed compared with Embodiment 1, so that an error of the detection temperature can be further reduced.

As in sections of 2.0 mm-2.8 mm, 4.4 mm-5.2 mm, and 6.8 mm-7.6 mm in FIG. 13, when the dimension W is not less than (integral multiple of L+S)−0.4 mm and is not more than (integral multiple of L+S)+0.4 mm (almost integral multiple of L+S), it is understood that the difference between the maximum and the minimum of the detection temperature falls within 0.4° C. or less. In this embodiment, W=2.4 mm and therefore the difference between the maximum and the minimum is 0° C.

In the device C of this embodiment, when W is a value which is almost integral multiple of L+S, a variation of the detection temperature of the thermistor 25 in the case where a contact position of the thermistor 25 and the heater 22 varies can be further suppressed compared with Embodiment 1. For that reason, temperature control of the heater 22 can be carried out with accuracy, so that the image quality can be further improved compared with Embodiment 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-113485 filed on Jun. 14, 2018, which is hereby incorporated by reference herein in its entirety.

What is claimed is:

1. A fixing device for fixing an image formed on a recording material, said fixing device comprising:

(A) a cylindrical film; and (B) a heater contacting an inner surface of said film, the image formed on the recording material being fixed on the recording material by heat of said heater, said heater including:

(a) an elongated substrate;

(b) a first electroconductive member provided on said substrate along a longitudinal direction of said substrate;

(c) a second electroconductive member provided on said substrate along the longitudinal direction;

(d) a plurality of heat generating resistors provided between said first electroconductive member and said second electroconductive member and electrically connected in parallel to said first electroconductive member and said second electroconductive member; and (e) a temperature detecting element configured to detect a temperature of said heater, wherein said first electroconductive member, said second electroconductive member and said plurality of heat generating resistors are provided on one surface side of said substrate, and said temperature detecting element is provided on the other surface side opposite to the one surface side of said substrate, the other surface side being a side on which said heater contacts said film and the one surface side is a side on which said heater does not contact said film, and wherein the following relationships are satisfied:

$$W \geq L \text{ and } W \geq S,$$

where W represents a dimension of said temperature detecting element measured in the longitudinal direction, L represents a dimension, measured in the longitudinal direction, of one of said heat generating resistors at least partially overlapping with said temperature detecting element with respect to the longitudinal direction, and S represents a dimension between adjacent heat generating resistors.

2. The fixing device according to claim 1, wherein said heater further satisfies the following relationship:

$$L \geq S.$$

3. The fixing device according to claim 1, wherein said heater further satisfies the following relationship:

$$L < S.$$

4. The fixing device according to claim 1, wherein said dimension W is a substantially integral multiple of (L+S).

5. The fixing device according to claim 1, wherein said substrate is made of a ceramic material.

6. A fixing device for fixing an image formed on a recording material, said fixing device comprising:

(A) a cylindrical film; and (B) a heater contacting an inner surface of said film, the image formed on the recording material being fixed on the recording material by heat of said heater, said heater including:

(a) an elongated substrate, said substrate including a ceramic layer;

(b) a first electroconductive member provided on said substrate along a longitudinal direction of said substrate;

(c) a second electroconductive member provided on said substrate along the longitudinal direction;

(d) a plurality of heat generating resistors provided between said first electroconductive member and said second electroconductive member and electrically connected in parallel to said first electroconductive member and said second electroconductive member; and (e) a temperature detecting element configured to detect a temperature of said heater, wherein said first electroconductive member, said second electroconductive member and said plurality of heat generating resistors are printed on one surface side of said ceramic layer, and said temperature detecting element is printed on the other surface side opposite to the one surface side of said ceramic layer, wherein the other surface side of said ceramic layer is a side on which said heater contacts said film and the one surface side is a side on which said heater does not contact said film, and wherein the following relationships are satisfied:

$$W \geq L \text{ and } W \geq S,$$

where W represents a dimension of said temperature detecting element measured in the longitudinal direction, L represents a dimension, measured in the longitudinal direction, of one of said heat generating resistors at least partially overlapping with said temperature detecting element with respect to the longitudinal direction, and S represents a dimension between adjacent heat generating resistors.

7. The fixing device according to claim 6, wherein said heater further satisfies the following relationship:

$$L \geq S.$$

8. The fixing device according to claim 6, wherein said heater further satisfies the following relationship:

$$L < S.$$

9. The fixing device according to claim 6, wherein said dimension W is a substantially integral multiple of (L+S).

* * * * *